United States Patent [19]

von Wedel

[11] Patent Number: 4,600,380

[45] Date of Patent: Jul. 15, 1986

[54] GRATE PLATES RETAINING SOLIDS AND IMPROVING GAS DISTRIBUTION TO BE USED IN GRATES FOR THE HEAT TREATMENT OF SOLID MATERIAL

[76] Inventor: Karl von Wedel, Amselstrasse 5, 3057 Neustadt, Fed. Rep. of Germany

[21] Appl. No.: 648,030

[22] Filed: Sep. 7, 1984

[30] Foreign Application Priority Data

Sep. 8, 1983 [DE] Fed. Rep. of Germany ..... 3332592

[51] Int. Cl.[4] ..... F27B 15/00; F27B 9/26; F26B 17/00; C21B 7/16

[52] U.S. Cl. ..... 432/58; 34/57 A; 266/178; 432/137

[58] Field of Search ..... 432/14, 58, 137; 34/57 A; 266/178, 179, 180

[56] References Cited

U.S. PATENT DOCUMENTS 1,802,959 4/1931 Simonds ..... 432/3 X 3,759,369 9/1973 Vering et al. ..... 266/178

*Primary Examiner*—John J. Camby

*Attorney, Agent, or Firm*—Thomas R. Morrison

[57] ABSTRACT

The combustion, cooling or other treatment of solids with the aid of gas may take place on a grate carrying or conveying said solids while the gas is passed through openings provided in the surface of the grate. In order to retain said solids entirely above said grate surface, to cool the grate surface sufficiently and to distribute the gas evenly in the solids to be treated, thin slots, inclined in the direction of transport, curved in the manner of a siphone and maintaining a high resistance to gas penetration are provided in grate plates composed to form a grate. The slots are formed between elements of such grate plates which can be manufactured by casting. The design of these grate plates avoids the necessity of handling dribblings passing said grates. The grate plates can be aerated through grate beams carrying them.

20 Claims, 8 Drawing Figures

FIG.1
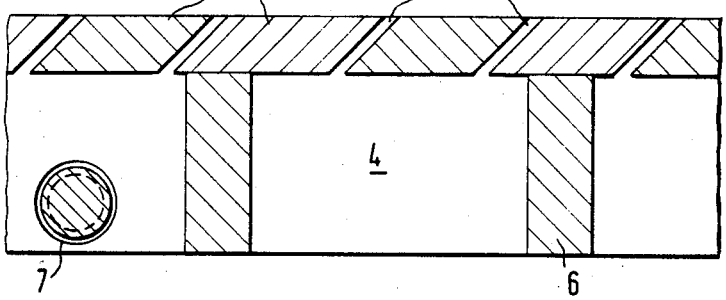
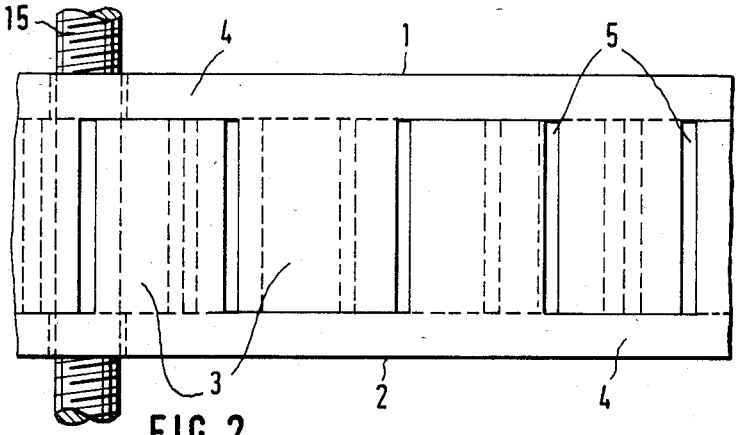
FIG.2
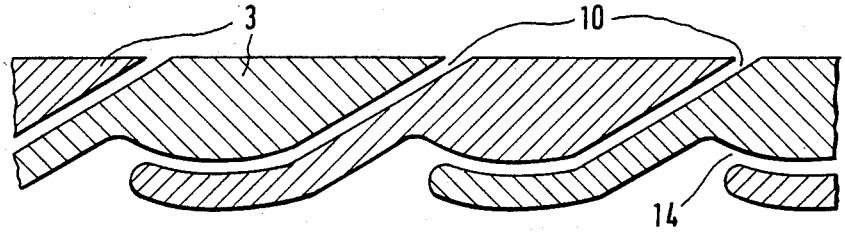
FIG.3

GRATE PLATES RETAINING SOLIDS AND IMPROVING GAS DISTRIBUTION TO BE USED IN GRATES FOR THE HEAT TREATMENT OF SOLID MATERIAL

BACKGROUND OF THE INVENTION

1. Field of the Invention

The invention refers to grate elements forming parts of bottoms of grates and to grates composed of such elements designed for the treatment or combustion of solid material with gas at high temperatures. Such grate elements which are provided in the way of grate bars, grate plates or grate blocks and dimensioned to avoid warping under thermal expansion are composed in an appropriate manner to form such grate bottoms and to determine the grate's working area. These bottoms carry said solid material and in most cases convey it either by their inclination or by their motion. Conveying may also take place by means of scrapers or by said gas with the aid of which said treatment is carried out. The bottoms are provided with openings for supplying the gas to the solid material. The openings are normally formed between grate bars or are part of grate plates or grate blocks.

2. Description of Prior Art

In order to meet special requirements of the gas penetration so-called jet bottoms are provided for grates. If high processing temperatures are necessary such jet bottoms consist of ceramic material. However, such material does not meet the requirements of mobile grates due to their low mechanical strength.

In conventional grate bottoms different ways of fulfilling the requirements of inner cooling and defined resistance for an even distribution of said gas into the layer of solids covering the grate bottom have been used. Cooling ribs or cooling channels provided at the gas inlet side of the grate bottom have been proposed and shown, e.g. in published German Patent Application Nos. 3 213 294 and 3 230 597.

The relative open grate area is a characterizing feature of the grate's resistance against gas penetration. E.g. 5% open grate area means that the supplied gas will develop a velocity within said openings 20 times as high as underneath said grate bottom, i.e. at the inlet for the gas into the grate elements. This gas velocity causes an upward force which may be greater than the grate plate's weight. In the case of pivoted grate plates according to published German Patent Application No. 1 758 067 this force is balanced by an additional weight.

High gas velocities emerging perpendicular to the working area may not be desirable. According to published German Patent Application No. 3 313 615 a grate block for an oscillating grate may therefore have an opening ejecting said gas approximately horizontally.

The advantages of such essentially horizontal air jets are described in U.S. Pat. No. 3,304,619. The jets effect the conveying of the solid material and improve the heat transfer in cooling processes. However, a heat resistant grate plate realizing these advantages is neither described nor proposed by this publication.

In conventional grates inclined slots arranged transversely with respect to the conveying direction are formed between single grate bars. Contrary to grate plates bedded directly on grate beams, these grate bars require intermediate brackets placed longitudinally on the grate beams. Such design, however, impedes an airtight attachment of gas compartments to the grate, especially at increased gas pressure, as well as the transmission of oscillating or travelling motions of the respective types of grates for conveying the solid material to be treated.

It is further known that a small open grate area in connection with a high velocity of the gas will diminish the amount of solids dribbling through the grate openings. However, such a grate still requires expensive means for the tapping of dribblings from said compartments and their further handling.

Only jet bottoms which e.g. have overlapping covers above said openings prevent solids from reaching said openings even when the gas supply is interrupted.

Published German Patent Application No. 2 005 869 describes a louvre type staired wall conveying powder material transverse to the penetration direction of the processing gas. The louvres carrying the powder are slightly lifted against gravity so that no powder can dribble out.

Both examples show in principle that impediments orientated to gravity will avoid dribblings. The solution with louvres, however, does not realize a sufficient resistance against gas penetration as is necessary for even gas distribution.

3. Objects of the Invention

It is therefore an essential object of the invention to suggest a grate element for a grate bottom being mechanically highly resistant and combining the advantages known from various designs of grate bars, grate plates, grate blocks or jet bottoms with respect to inner cooling, resistance against gas penetration and prevention of dribblings.

It is a further object of the invention to suggest grate plates which can be manufactured by casting and still provide openings finely distributed, inclined and arranged transversely with respect to the conveying direction.

It is yet another object of the invention to suggest a grate design bedding grate plates directly on transverse grate beams without intermediate brackets, thus facilitating the attachment of gas compartments and the exchange of said grate plates even during operation of the grates.

SUMMARY OF THE INVENTION

To achieve these objects the invention provides grate elements shaped in the manner of boxes having an essentially rectangular cross section in plan view and with lateral brackets serving as intermediate brackets and with cross-bars extending between the lateral brackets, serving as grate bars and forming slots between each other essentially transverse to the conveying direction of the grate, these slots being sized and shaped with respect to the working area of the grate to constitute a high resistance against the penetration of the gas and an impediment against the intrusion or penetration of solids.

According to a preferred embodiment of the invention grate elements are provided with lateral brackets and cross-bars rigidly attached to each other to facilitate their handling.

According to another embodiment of the invention the grate elements are provided with lateral brackets and cross-bars locked to each other positively to facilitate their assembly.

The invention also provides grate elements with lateral brackets and cross-bars forming two complemental parts, each comprising one side piece and a plurality of transversely extending cross-bars to facilitate both handling and assembly.

The following essential advantages may be attained by the invention:

1. The grate elements basically perform the same function as hitherto known aeration boxes covered by semipermeable cloth or other permeable materials, which are commonly used at low temperatures and in the treatment of fine powder. The simple application of functionally comparable elements is thus made possible for hot and coarse solids.

2. The grate elements can be mounted directly on grate beams, thus facilitating the airtight attachment of gas compartments at or between the grate beams or facilitating the imposure of any oscillating or travelling motion onto the entire grate.

3. The grate elements can be forced together on grate beams without developing additional openings between each other so that merely the slots designed between the grate bars effect the resistance against gas penetration and prevent the passage of solids.

4. During interruptions of the gas supply additional impediments against dribblings offset all further downstream means for the handling and possibly any recycling of dribblings.

5. The grate elements, when made of complementary parts, are slightly mobile through the slots separating them thus contributing to the cleaning of said slots from any fine solids which may intrude.

Expediently there is provided for slots which are inclined with respect to the grate area, i.e. the working area of the grate. Preferably the inclination follows the direction of transport of the solids to allow the emerging gas to assist said transport. As the gas will convey especially any fine fraction of the solids the grate elements according to the invention are of special advantage in combination with conventional scrapers which create serious problems in transporting any fine fraction.

Another essential advantage of inclined slots is the fact that with slots preferably inclined at 40 degrees or less with respect to the grate area the emerging gas jets remain adjacent to the grate's surface. Thus the surface will be cooled in addition to the inner cooling of the grate plate and the gas distributed into the solids from a gas layer which is rather independent of the pattern of the slots.

According to another advantageous aspect of the invention slots may be provided which are curved in the manner of a siphon towards the gas inlet relative to gravity. Such slots represent a very simple form of an obstacle against dribblings in combination with inclined slots.

According to another advantageous embodiment of the invention the slots may incorporate throttles and chambers whereby the inner cooling may be improved by the effect according to Joule-Thomson. Also, the resistance to gas penetration can be increased by such a structure of the slots.

The grate elements according to the invention may be arranged in rows and the rows arranged in series to form a grate area. The area is provided with compartments from underneath for supplying the gas (air) required for the treatment of the solids on the grate.

The grate elements can preferably be tightly attached to hollow grate beams which are connected to the gas supply extending into the inside of the grate elements. Such an arrangement is of great advantage for grates requiring narrow compartments for the control of the gas supply. Compartments incorporating means for the handling of dribblings usually comprise several rows of grate plates. The invention enables a control of the gas supply to each single row. Further means inside the hollow grate beams may control the gas supply to the sides of the grate.

According to a preferred embodiment of the invention the gas emerging from the slots may convey the solids to be treated. In the case of fine solids or of coarse solids, the latter in conjunction with a sloped grate, the gas may form the sole conveying means. This is of considerable advantage with stationary grates or extremely hot solids.

According to yet another aspect of the invention means attached to the hollow grate beam may be provided for pulsing the gas.

There may also be provided a valve attached to the hollow grate beam for releasing the gas at controlled intervals.

Both such means make the amount of the gas required for conveying increasingly independent of the amount of gas necessary for the treatment of the solids.

BRIEF DESCRIPTION OF THE DRAWINGS

Other and further objects of the present invention will be apparent from the following description and claims and are illustrated in the accompanying drawings, which by way of illustration schematically show preferred embodiments of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims. In the drawings FIG. 1 shows part of a grate element in longitudinal sectional view, FIG. 2 shows the grate element of FIG. 1 in plan view, FIG. 3 shows a longitudinal sectional view of part of another embodiment of a grate element with cross-bars and slots.

DETAILED DESCRIPTION OF THE PREFERRED EMBODIMENTS

Figure 4:
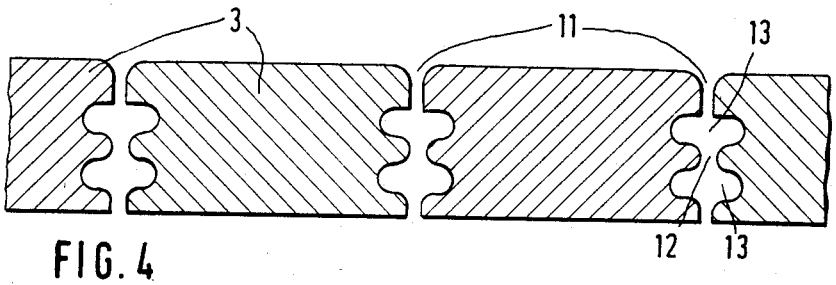
FIG. 4 shows a longitudinal sectional view of part of a further embodiment of a grate element with cross-bars and slots.

A grate element 19, part of which is shown in FIGS. 1 and 2 comprises two parts 1, 2, each comprising side pieces or lateral brackets 4 and cross-bars 3. The grate element may, for example, be produced by casting of a heat resistant alloy or ceramic material and will form an element or part of a grate row 20 shown in and described in connection with FIG. 8. The cross-bars 3 are alternatingly cast with an opposite side piece 4 of parts 1, 2. The arrangement of the cross-bars 3 on the side pieces 4 and their distance with respect to each other is such that after the composition of parts 1 and 2 the cross-bars 3 form slots 5 between them.

A grate surface, part of which is shown in FIG. 2 is constituted by cross-bars 3, side pieces 4 and slots 5. The area ratios of cross-bars 3:side pieces 4:slots 5 may range from 1:5:1 to 40:1:1. The slots 5 may be arranged other than in a position essentially perpendicular to side pieces 4 as shown in FIG. 2, e.g. caused by conical moulds, without disadvantage.

Figure 5:
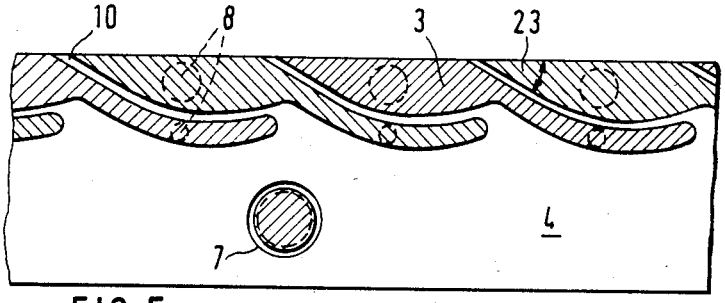
FIG. 5 shows a longitudinal sectional view of part of yet another embodiment of a grate element.

FIG. 1 shows slots 5 inclined towards the direction of transport. The inclination, whose angle 23 is shown in FIG. 5 should not be more than 40°. It is particularly advantageous to provide inclination angles of between 30° and 35°. It may be advantageous, however, to incline the slots 5 backwards, e.g. in order to stir solids to be treated and conveyed on the grate.

The design of slots 5 can meet various requirements with respect to inclination, curvature or cone. Different slots may be incorporated in one grate element. FIG. 3 shows siphon-shaped slots 10 raised against the direction of gravity at a gas inlet end 14 to form an impediment against dribblings from the grate.

FIG. 4 shows slots 11 incorporating throttles 12 and chambers 13 to improve the inner cooling of the grate element by the effect of Joule-Thomson and to increase the resistance to gas penetration without increasing the exit velocity of the gas. There may be combinations of slots 10 and 11 in the grate element units and/or distributed over the effective grate area depending on the special requirements of the grate, the treatment to be carried out, the material to be treated, etc.

Figure 6:
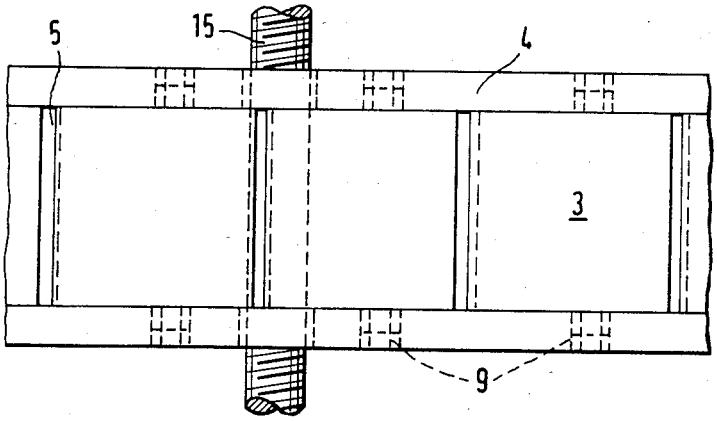
FIG. 6 shows the grate element of FIG. 5 in plan view.

FIGS. 5 and 6 show another preferred embodiment of grate elements in which side pieces 4 and cross-bars 3 may have pivots 8 fitting into boreholes 9 of the side pieces 4. Instead of pivots and boreholes, the side pieces 4 may as well have supports or grooves to receive the cross-bars 3, which supports or grooves correspond to the mechanical strength of ceramic material (if such is used instead of metallic alloys) better than pivots would do.

One or more of the preferred embodiments of grate elements shown in FIGS. 1 and 2 or FIGS. 5 and 6, respectively, may be forced together by spring loaded tension rods 15 reaching through boreholes 7. By such a structure any gaps between side pieces 4 can be avoided. The side pieces 4 may have spacers 6 to determine their proper position. In the case of ceramic material the rows of grate elements are preferably forced together by compression from both ends.

Figure 7:
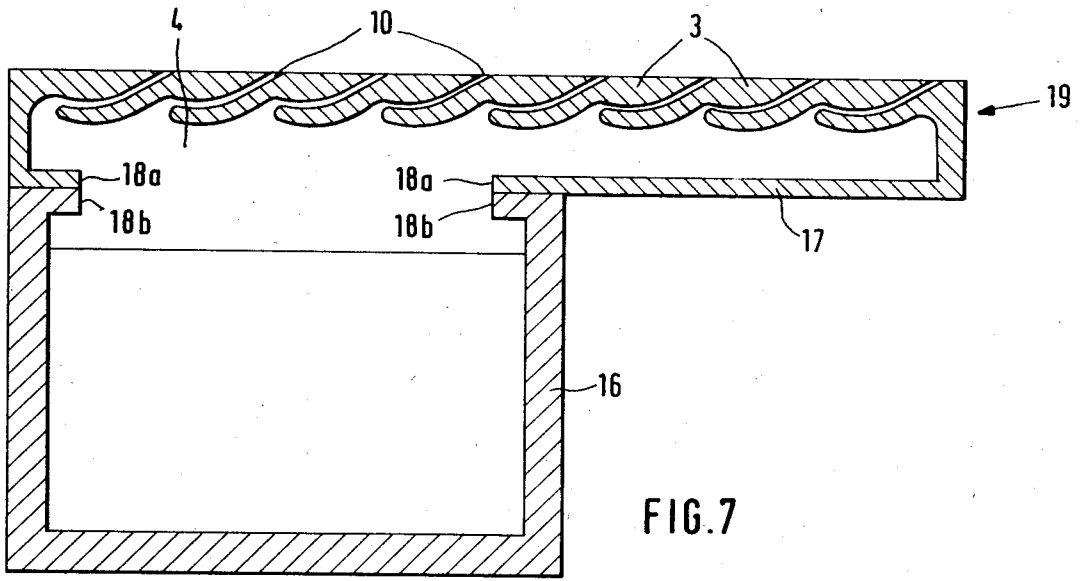
FIG. 7 shows a longitudinal sectional view of a modified embodiment of a grate element with a hollow grate beam prepared for the gas supply.

The side pieces 4 may be mounted on and attached to the grate beams in many ways depending on the type of grate and the type of gas supply. FIG. 7 shows a preferred embodiment providing a grate element 19 with side pieces 4 locked to grate beams 16 in order to be able to shift the entire row of grate elements across and beyond the grate for substituting any element during hot operation.

FIG. 7 further shows that the grate element 19 is provided with siphon-shaped slot 10. The grate element 19 is mounted on a hollow grate beam 16. There is provided an airtight connection between the grate element 19 and the grate beam 16 for the supply of gas to the interior of the grate element via said grate beam through openings 18*a*, 18*b*. One of the side pieces 4 of the grate element opposing each other has a bottom plate 17 thus forming a space for containing the gas. In the case of oscillating grates and overlapping grate elements the bottom plate 17 will provide a smooth and tight sliding connection with the consecutive grate element not shown in FIG. 7. It can be observed that the frequency required for the conveying of solids treated will be reduced due to the air emerging from slots 10, thus saving considerably in wear of the grate elements.

Figure 8:
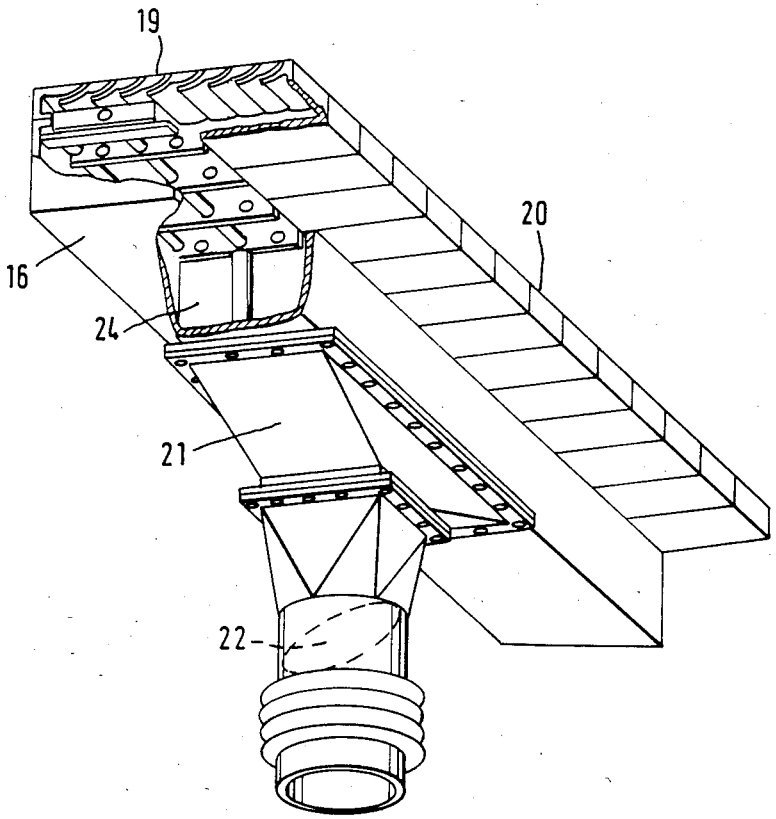
FIG. 8 shows a perspective view of a row of grate elements mounted on a hollow grate beam.

The aeration possible according to the arrangement shown enables a particularly fine division of the gas (air) chambers for the gas supply underneath the grate area. For a further and even finer distribution of the gas there may be provided adjustable flaps 24 as shown in FIG. 8.

When conveying the solids entirely by the emerging gas the amount of which being most likely limited and defined by the specific process, it is expedient to control the velocity of the gas emerging from the slots 10 independently of the gas/solid ratio. To this end, the hollow grate beams 16 may comprise means 22 shown in FIG. 8 to pulse the gas, which pulsing means can be arranged upstream of a gas supply connection 21 on the grate beam 16 in a gas supply tube not provided with a reference numeral in FIG. 8. However, the gas may as well be released to the grate plates at controlled intervals by means of not-shown valves forming part of the grate beams 16 or of an aeration system based on the same principle.

What is claimed:

1. A grate element shaped as a grate plate and designed to form part of a working area of a grate structure for burning, cooling or otherwise heat-treating solid material by applying processing gas thereto while transporting said material in a predetermined transporting direction, said grate element having a substantially planar working surface for receiving and transporting said material, said working surface being provided with an array of recesses having a gas inlet and a gas outlet opening into said working surface for introducing said gas through said grate element into said material, wherein (a) said grate element is shaped in the form of an elongated hollow substantially rectangular box having a width extending substantially transverse to said transporting direction and a length extending substantially in said transporting direction, (b) said grate element comprises a pair of spaced lateral brackets forming side walls of said box and extending essentially in said transporting direction, (c) said grate element further comprises a plurality of grate bars each extending perpendicularly between the upper ends of said lateral brackets, essentially transverse to said transporting direction, and having planar top surfaces forming the working surface of said grate element, (d) said grate bars are spaced with respect to each other such that adjacent grate bars form a slot between each other, extending essentially transverse to said transporting direction, and forming said recesses for the introduction of said gas, and (e) each of said grate bars has a cross-section perpendicular to said working surface to define a cross section of said slots which constitutes a high resistance to the passage of said gas and an impediment against said solid material intruding into said slots.

2. A grate element as claimed in claim 1, wherein said lateral brackets are secured to said grate bars to form a rigid grate plate.

3. A grate element as claimed in claim 1, wherein said lateral brackets and said grate bars are locked positively to each other.

4. A grate element as claimed in claim 1, wherein said lateral brackets and said grate bars form two complemental parts, each part comprising one of said lateral brackets and a plurality of transversely extending grate bars arranged in alternating manner such that the parts interfit with each other in a meshing manner.

5. A grate element as claimed in claim 1, wherein said slots are inclined with respect to said working surface.

6. A grate element as claimed in claim 5, wherein said slots are inclined at a maximum angle of 40° with respect to said working surface.

7. A grate element as claimed in claim 4, wherein the lower ends of said slots are curved in the manner of a siphon rising towards said gas inlet with respect to gravity.

8. A grate element as claimed in claim 5, wherein the lower ends of said slots are curved in the manner of a siphon rising toward said gas inlet with respect to gravity.

9. A grate element as claimed in claim 1, wherein said slots incorporate throttles and chambers.

10. A grate comprising a plurality of grate elements as claimed in claim 1, said grate elements being arranged in rows which are determined by grate beam means carrying a predetermined number of said grate elements one beside the other in a direction transverse to said conveying direction and of which rows a plurality is arranged in series in said conveying direction, wherein (a) said grate beam means are hollow carrier elements and connected to supply means for said processing gas and (b) said grate elements are attached to said hollow grate beams in a gastight manner for introducing said processing gas from said hollow grate beams into the interior of said box-shaped grate elements.

11. A grate comprising a plurality of grate elements as claimed in claim 3, said grate elements being arranged in rows which are determined by grate beam means carrying a predetermined number of said grate elements one beside the other in a direction transverse to said conveying direction and of which rows a plurality is arranged in series in said conveying direction, wherein (a) said grate beam means are hollow carrier elements and connected to supply means for said processing gas and (b) said grate elements are attached to said hollow grate beams in a gastight manner for introducing said processing gas from said hollow grate beams into the interior of said box-shaped grate elements.

12. A grate comprising a plurality of grate elements as claimed in claim 7, said grate elements being arranged in rows which are determined by grate beam means carrying a predetermined number of said grate elements one beside the other in a direction transverse to said conveying direction and of which rows a plurality is arranged in series in said conveying direction, wherein (a) said grate beam means are hollow carrier elements and connected to supply means for said processing gas and (b) said grate elements are attached to said hollow grate beams in a gastight manner for introducing said processing gas from said hollow grate beams into the interior of said box-shaped grate elements.

13. A grate comprising a plurality of grate elements as claimed in claim 8, said grate elements being arranged in rows which are determined by grate beam means carrying a predetermined number of said grate elements one beside the other in a direction transverse to said conveying direction and of which rows a plurality is arranged in series in said conveying direction, wherein (a) said grate beam means are hollow carrier elements and connected to supply means for said processing gas and (b) said grate elements are attached to said hollow grate beams in a gastight manner for introducing said processing gas from said hollow grate beams into the interior of said box-shaped grate elements.

14. A grate as claimed in claim 10, wherein said gas emerging from said slots forms conveying means for transporting said solid material in said transporting direction.

15. A grate as claimed in claim 12, wherein said gas emerging from said slots forms conveying means for transporting said solid material in said transporting direction.

16. A grate as claimed in claim 13, wherein said gas emerging from said slots forms conveying means for transporting said solid material in said transporting direction.

17. A grate as claimed in claim 14, wherein said grate beam means are associated to gas pulsing means for pulsingly supplying said gas to said slots.

18. A grate as claimed in claim 15, wherein said grate beam means are associated to gas pulsing means for pulsingly supplying said gas to said slots.

19. A grate as claimed in claim 15, wherein said grate beam means are associated to valve means for controlling a supply of said gas to said slots at intervals.

20. A grate element for use as a grate plate to be mounted upon at least one gate beam and forming a portion of a working area of a grate structure for burning, cooling or otherwise heat-treating solid material by applying processing gas thereto while transporting said material in a predetermined transporting direction, said grate element comprising:

a body in the shape of an elongated hollow box of substantially rectangular shape, said box defining a width essentially transverse to said transporting direction and a length extending essentially in said transporting direction, a pair of lateral brackets forming side walls of said box and extending essentially in said transporting direction, a plurality of grate bars each affixed to and extending perpendicularly between said pair of lateral brackets in a direction substantially transverse to said transporting direction, each of said grate bars having a planar upper surface and providing for said grate structure a substantially planar top working surface for receiving and transporting said material, and a plate affixed to and extending between the lower ends of said pair of brackets and constituting the bottom wall of said box, said plate having at least one opening therein communicating with the interior of said grate beam upon which said grate element is mounted for receiving a flow of gas from said grate beam into the interior of said hollow box, said grate bars being spaced apart from each other to provide a slot between each pair of adjacent grate bars, said slots extending between said pair of lateral brackets and essentially transverse to said transporting direction, and forming spaced recesses for the passage of said gas from the interior of said hollow box to the exterior of its top working surface, each of said grate bars having a cross-section perpendicular to said top working surface to define a cross section of said slots which constitutes a high resistance to the passage of said gas and an impediment against said solid material intruding into said slots.

* * * * *